US007467433B2

(12) United States Patent
Wong

(10) Patent No.: US 7,467,433 B2
(45) Date of Patent: Dec. 23, 2008

(54) CHANGING TABLE WITH INTEGRATED DIAPER DISPENSER

(75) Inventor: Sue Wong, Tempe, AZ (US)

(73) Assignee: Ubi, LLC, Tempe, AZ (US)

( * ) Notice: Subject to any disclaimer, the term of this patent is extended or adjusted under 35 U.S.C. 154(b) by 0 days.

(21) Appl. No.: 11/745,261

(22) Filed: May 7, 2007

(65) Prior Publication Data

US 2008/0060135 A1 Mar. 13, 2008

Related U.S. Application Data

(60) Provisional application No. 60/825,436, filed on Sep. 13, 2006.

(51) Int. Cl.
*A47D 13/00* (2006.01)

(52) U.S. Cl. ..... 5/655; 5/93.2; 108/25; 108/50.14

(58) Field of Classification Search ..... 5/93.1, 5/93.2, 655, 947; 108/25, 50.14
See application file for complete search history.

(56) References Cited

U.S. PATENT DOCUMENTS

| | | | | |
|---|---|---|---|---|
| 2,683,639 | A * | 7/1954 | Brenny | 108/132 |
| 4,188,678 | A * | 2/1980 | Rawolle | 5/105 |
| 5,067,417 | A * | 11/1991 | Marmentini et al. | 108/36 |
| 6,497,441 | B1 * | 12/2002 | Mahmood et al. | 296/24.34 |
| 6,928,680 | B1 * | 8/2005 | Cai et al. | 5/655 |
| 7,007,314 | B2 * | 3/2006 | Courouzos | 4/572.1 |
| 7,191,712 | B2 * | 3/2007 | Goldberg et al. | 108/26 |

* cited by examiner

*Primary Examiner*—Michael Trettel
(74) *Attorney, Agent, or Firm*—Jeffrey D. Moy; Weiss & Moy, P.C.

(57) ABSTRACT

An infant changing table has a top surface which is concaved in shape. An opening is formed in a lower area of the top surface. A support structure is coupled to a back area of the top surface to elevate the top surface. A diaper dispensing container is coupled to the opening for holding a plurality of diapers. Fasteners are coupled to the top surface around the opening to hold down a top diaper being dispensed from the diaper dispensing container.

20 Claims, 8 Drawing Sheets

CHANGING TABLE WITH INTEGRATED DIAPER DISPENSER

RELATED APPLICATION

This application is related to U.S. Provisional Application Ser. No. 60/825,436, filed Sep. 13, 2006, in the name of the same inventor listed above, and entitled, "A CHANGING TABLE WITH INTEGRATED DIAPER DISPENSER". The present patent application claims the benefit under 35 U.S.C. §119(e).

BACKGROUND OF INVENTION

1. Field of Invention

The present invention relates to infant accessories, and more particularly to an infant changing table with a diaper dispensing container.

2. Description of Related Art

The application of an infant's diaper is very important. If placed improperly, the diaper will leak and sometimes fall off causing further problems for the parents. In addition, an improper fit may cause discomfort for the child. One source of misapplication is due to difficulties during the diaper changing process.

Most of the time, the infant is not motionless during the diaper changing process. The person changing the diaper must keep the diaper and the infant steady to ensure a proper fit, but the infant will generally move constantly complicating the changing process. The baby may roll from side to side, creating difficulties while putting on the new diaper. Furthermore, the infant may kick its legs and move the new diaper into an improper changing position. The process becomes more difficult as the baby gets older due to increased size and strength.

Furthermore, current diaper design also complicates the changing process. Diapers come folded for easy packaging and storage. The caregiver must unfold and place the diaper under the child during the changing process. Moreover, in order to minimize leaks, diapers today have elastic bands at the waist that the caregiver has to stretch before fastening the diaper further complicating the process.

As a result, while changing a diaper, a person must keep a moving infant stationary, and remove the old diaper and clean the child. Next, the caregiver must grab, unfold, and place a new diaper under an infant. The caregiver must then apply any necessary creams, and secure the fasteners while stretching out an elastic band. The above process is difficult enough for a single person when the baby is stationary. However, the process becomes more difficult as the baby becomes more active.

Therefore, it would be desirable to provide a device that assists in the diaper changing process that overcome the above problems. The device that assists in the diaper changing process will retrieve and help to secure a new diaper in position in order to prevent movement of the diaper during the diaper changing process.

SUMMARY OF INVENTION

In accordance with one embodiment of the present invention, an infant changing table is disclosed. The infant changing table has a top surface which is concaved in shape. An opening is formed in a lower area of the top surface. A support structure is coupled to a back area of the top surface to elevate the top surface. A diaper dispensing container is coupled to the opening for holding a plurality of diapers. Fasteners are coupled to the top surface around the opening to hold down a top diaper being dispensed from the diaper dispensing container.

The foregoing and other objects, features, and advantages of the invention will be apparent from the following, more particular, description of the preferred embodiments of the invention, as illustrated in the accompanying drawing.

BRIEF DESCRIPTION OF DRAWINGS

The present invention will become more fully understood from the detailed description and the accompanying drawings, wherein.

DETAILED DESCRIPTION

The present invention is an infant changing table with a diaper dispensing container. The infant changing table has a top surface which has fasteners that hold the diaper into place while changing an infant. The top surface of the present invention also includes a diaper dispensing container that holds a stack of new diapers. To protect the stack of new diapers during the changing process, the container has a top cover over its opening. In addition, the diaper dispensing container includes a mechanism that dispenses a fresh diaper after removing the baby from the table and prepares the caregiver for the next diaper change.

Referring to the Figures, an infant changing table 10 of the present invention will be disclosed. The changing table 10 has a top surface 12. In accordance with one embodiment of the present invention, the top surface 12 has curved ends 14 and 16 so that the top surface 12 is slightly curved or concave. The curved ends 14 and 16 reduce the infant's movements during a diaper change. As a baby attempts to move, the curved ends 14 and 16 will prevent the baby from rolling. In accordance with one embodiment of the present invention, a top end of the top surface 12 is wider than the bottom end. The wider top end provides comfort for the child since a baby's shoulders are wider than its feet. When changing a diaper, the caregiver places the infant oriented lengthwise on the top surface 12 with the head located at the wider top end. A safety strap may be coupled to a top surface 12. The safety strap would be used to prevent a child from rolling off the changing table 10.

The top surface 12 may contain an anti-microbial/anti-bacterial treatment/coating. The anti-microbial/anti-bacterial treatment/coating is used to prevent bacterial growth on the changing table 10 which may cause odors and may be unhealthy for the child being placed on the changing table 10.

Figure 14:
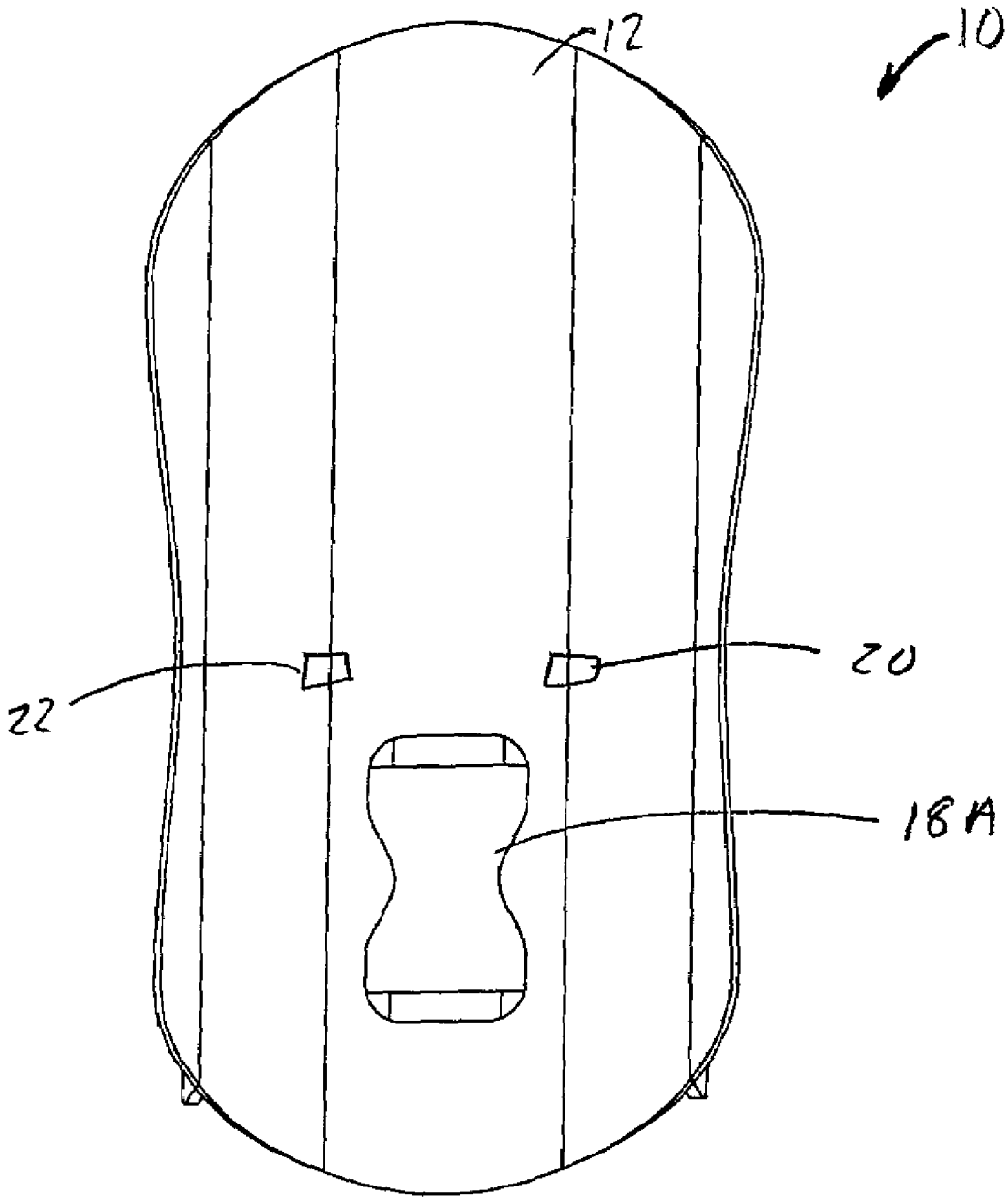
FIG. 14 is a top view of the top surface of the infant changing table of the present invention.
Figure 15:
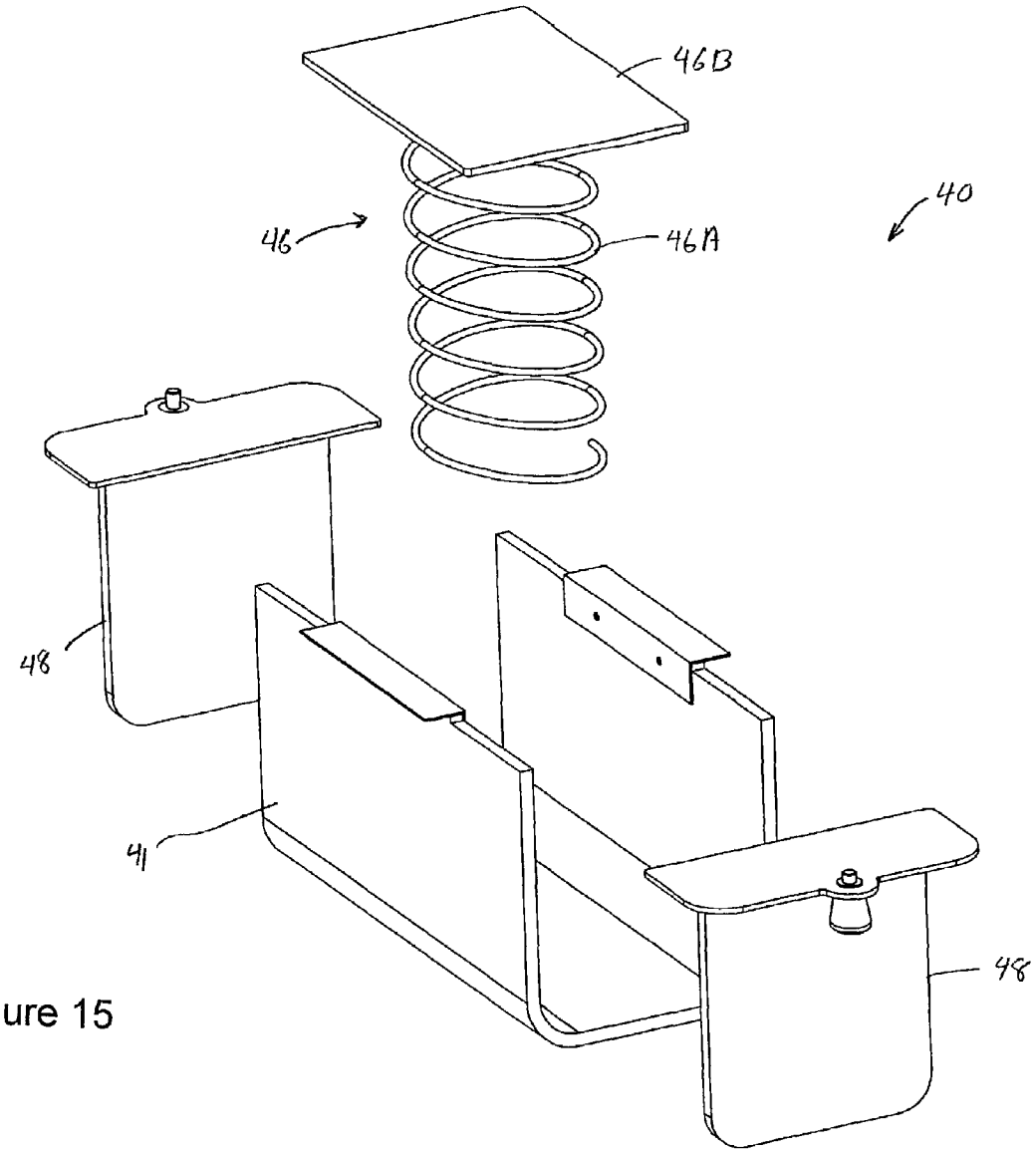
FIG. 15 is an exploded view of another embodiment of the diaper dispensing container used in the infant changing table of the present invention.

An opening 18 is formed in the top surface 12. The opening 18 is formed at one end of the top surface 12 where the rear end of the baby will be positioned during the changing process. The opening 18 will generally be positioned equidistant between the two ends 14, 16. As shown in FIGS. 1-2, 5 and 8, the opening 18 may be rectangular in shape. In accordance with another embodiment shown in FIG. 14, the opening 18 may have curved side edges 18A. The curved side edges 18A protrude in an inward direction towards an interior of the opening 18. The curved side edges 18A are used for safety reason. The curved side edges 18A will prevent a baby's head or other body parts from entering the opening and avoid becoming stuck in the opening 18. The curved side edges 18A are further used to secure portions of the diapers below the opening 18.

As shown in Figures, a plurality of fasteners 20, 22, are coupled to the top surface 12 of the changing table 10. The fasteners 20, 22, are generally located around the opening 18. The fasteners 20, 22, are located in the middle of the top surface 12 lengthwise approximately where the infant's waist would be. The fasteners 20, 22, hold a new diaper in place while changing an infant. In the shown embodiment of the changing table 10, the top surface 12 has two fasteners 20, 22, but any number of fasteners can be included to securely hold the diaper in place. The fasteners 20, 22, can be hook and loop fastener, clips, adhesives, or other devices for securing the diaper in place.

Figure 1:
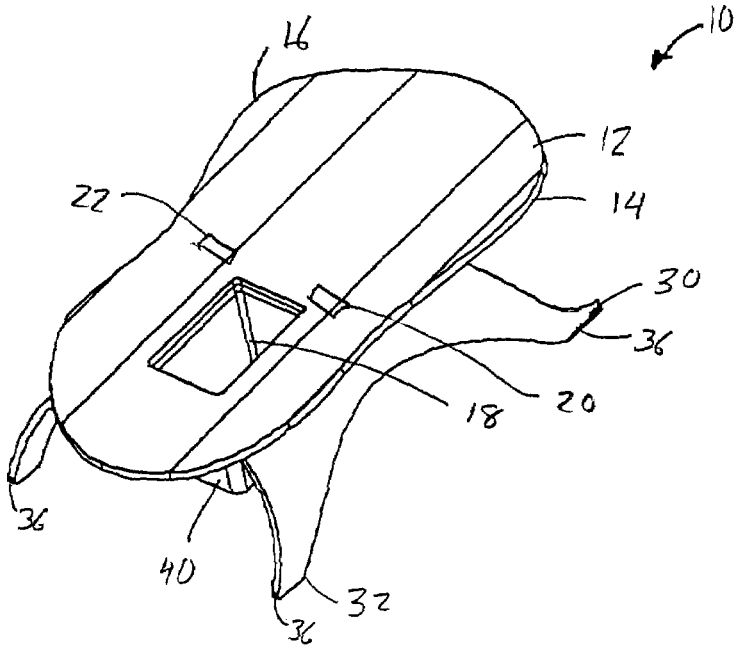
FIG. 1 is an elevated perspective view of the infant changing table of the present invention.
Figure 2:
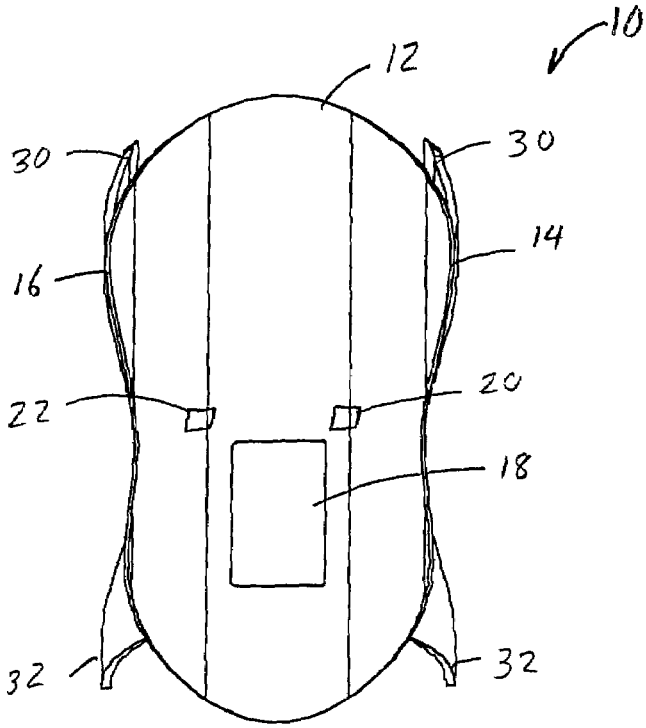
FIG. 2 is a top view of the infant changing table of the present invention.
Figure 3:
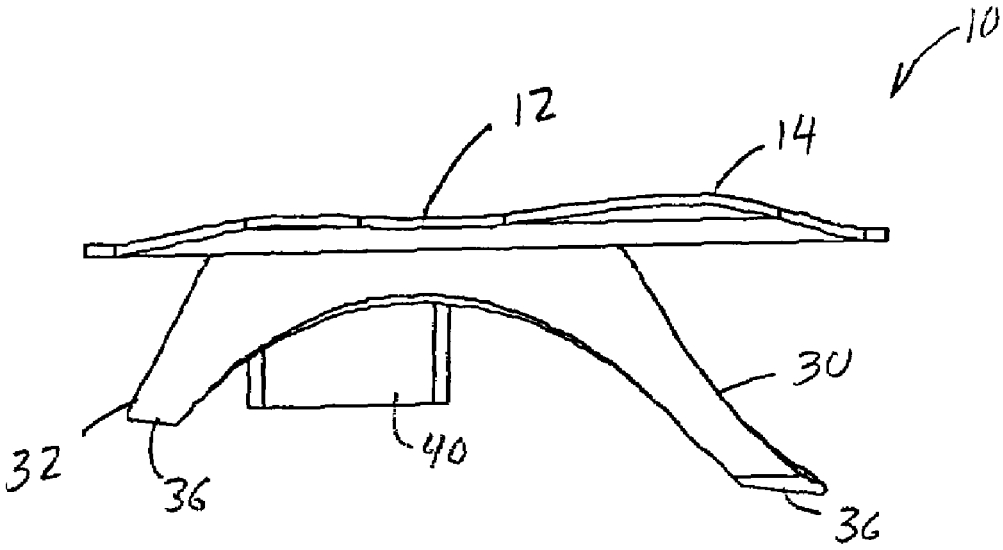
FIG. 3 is a side view of the infant changing table of the present invention.
Figure 4:
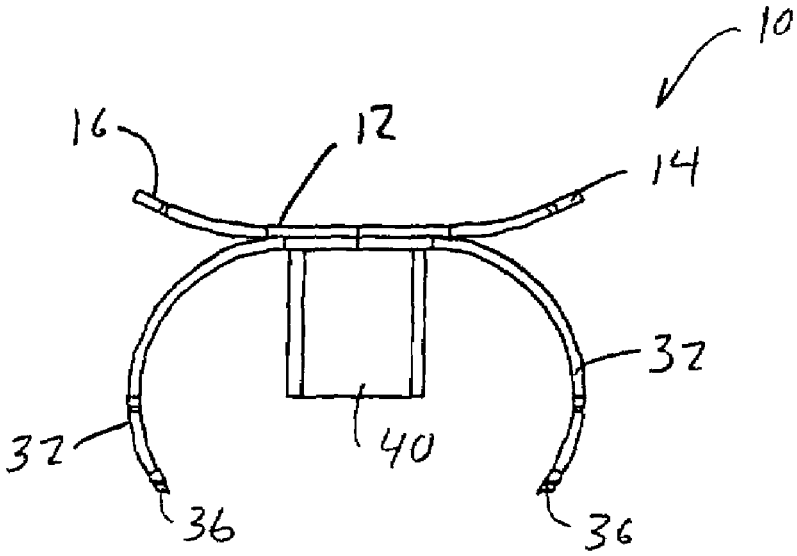
FIG. 4 is a front view of the infant changing table of the present invention.
Figure 5:
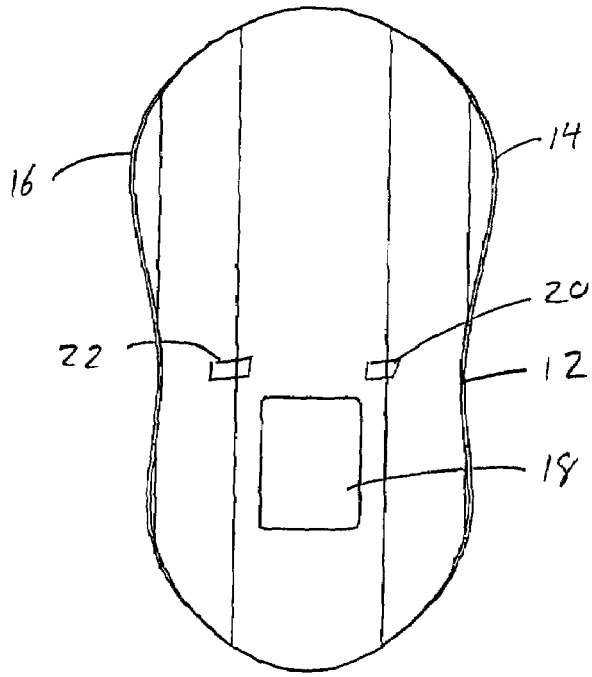
FIG. 5 is a top view of the top surface of the infant changing table of the present invention.
Figure 6:
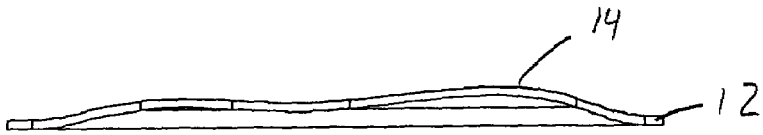
FIG. 6 is a side view of the top surface of the infant changing table of the present invention.
Figure 7:
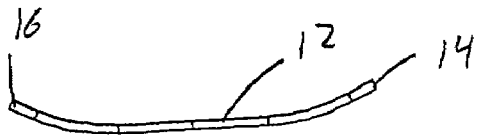
FIG. 7 is a front view of the top surface of the infant changing table of the present invention.
Figure 8:
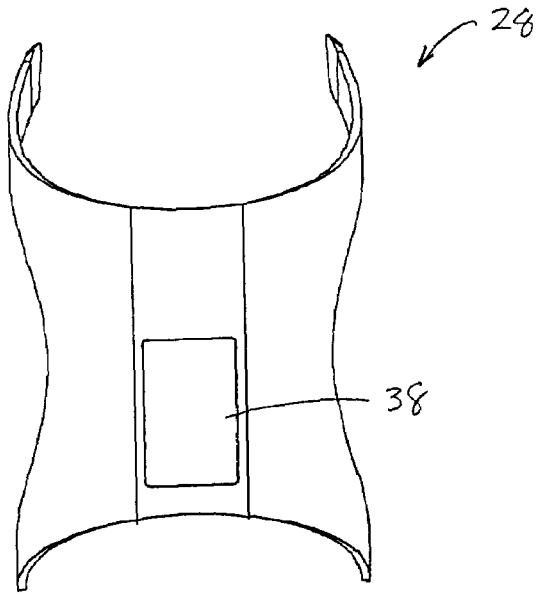
FIG. 8 is a top view of the support structure of the infant changing table of the present invention.
Figure 9:
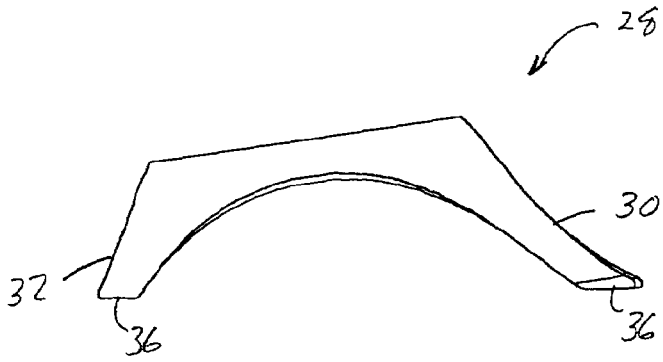
FIG. 9 is a side view of the support structure of the infant changing table of the present invention.
Figure 10:
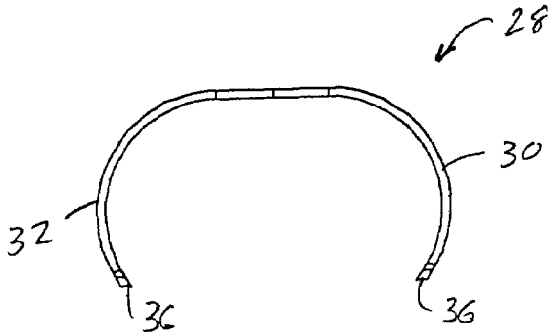
FIG. 10 is a front view of the support structure of the infant changing table of the present invention.
Figure 11:
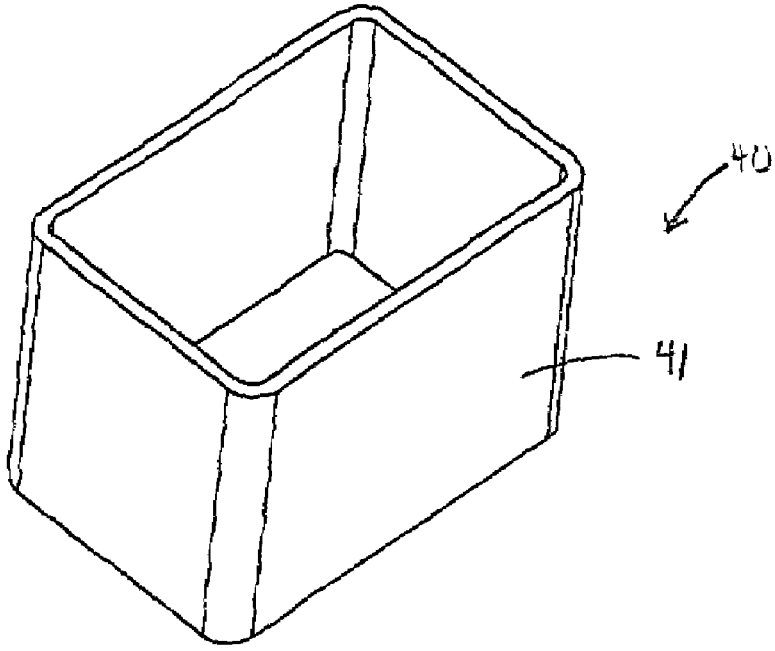
FIG. 11 is an elevated perspective view of the diaper dispensing container used in the infant changing table of the present invention with the top cover removed.
Figure 12:
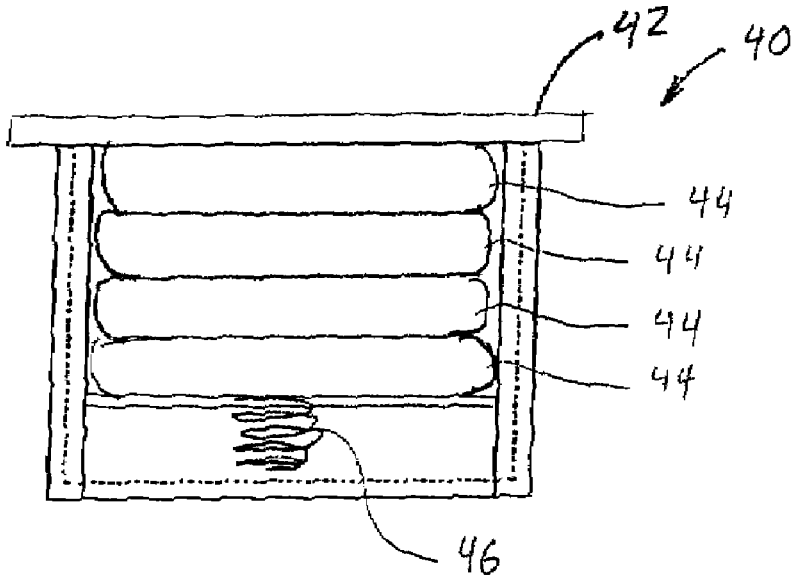
FIG. 12 is a side sectional view of the diaper dispensing container used in the infant changing table of the present invention.
Figure 13:
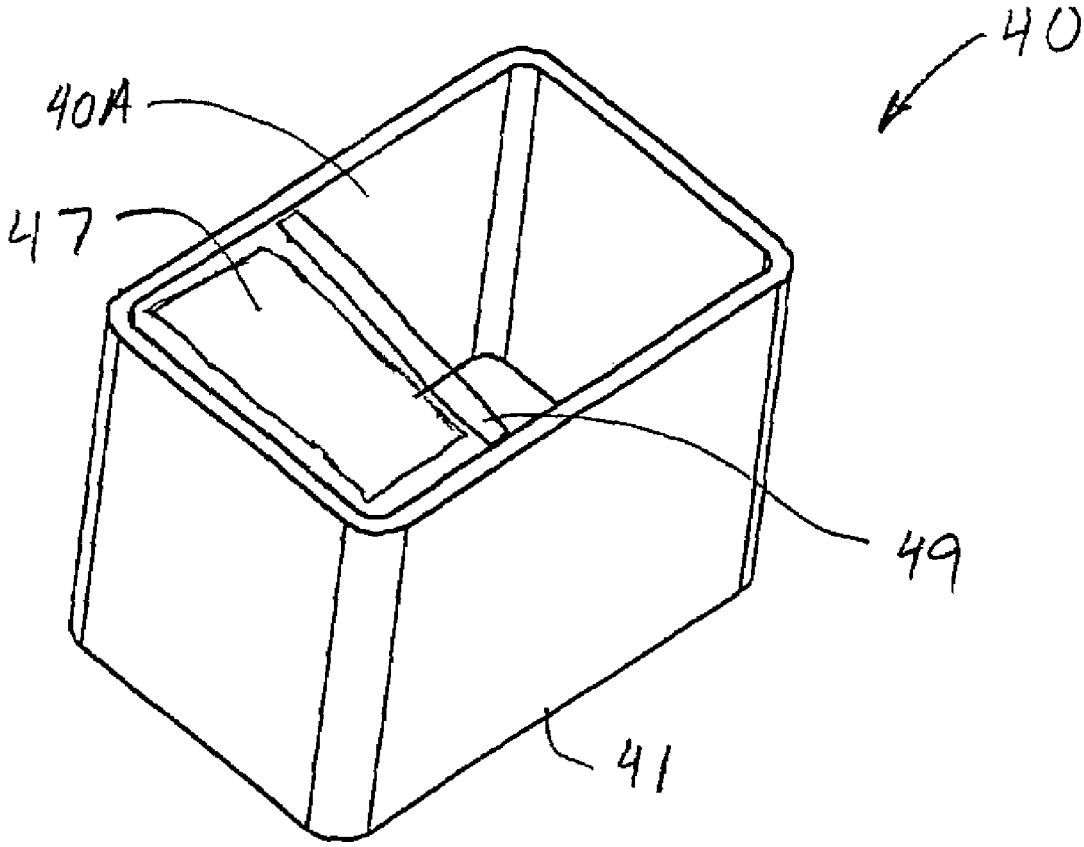
FIG. 13 is an elevated perspective view of the diaper dispensing container insert which allows the container to accommodate different diaper sizes.

Referring to the Figures and more specifically FIGS. 8-10, attached to the top surface 12 of the changing table 10 is a support structure 28. The support structure 28 is used to elevate the top surface 12. The support structure 28 hold the changing table 10 in an elevated position to aid in the diaper changing process. By elevating the top surface 12, a person will not have to bend as much while changing a baby's diaper. The support surface 28 is further used to keep the baby's head slight elevated above the baby's feet for the baby's comfort when changing the baby's diaper. The support structure 28 may be interchangeable. Thus, different support structure 28 may be used. For example, based on where the changing table 10 is being used, a person using the changing table 10 may want to alter the height of the changing table 10. Thus, the user may attach a different support structure 28 to lower or raise the changing table 10.

The support structure 28 has a first pair of legs 30 and a second pair of legs 32 which extend downward from a top surface 34 of the support structure 28. In accordance with one embodiment of the present invention, the first pair of legs 30 and a second pair of legs 32 are designed to allow the first pair of legs 30 and a second pair of legs 32 to latch on to an object. For example, the changing table 10 may be placed on top of a small table, bassinet, or like item so that the first pair of legs 30 and a second pair of legs 32 of the support structure 28 attached and locks to the edges of the table, bassinet, or like item.

As shown in the Figures, the first pair of legs 30 of the support structure 28 is slightly higher than the second pair of legs 32. This will allow one to keep the baby's head slight elevated above the baby's feet when changing the baby's diaper. A skid resistant coating 36 may be placed on the bottom surfaces of the first pair of legs 30 and the second pair of legs 32. The skid resistant coating 36 will prevent the changing table 10 from moving if the baby or the person changing the baby accidentally shakes or bumps the changing table 10.

In the shown embodiment, the supporting surface 28 is a curved piece providing support to the top surface 12. In addition, the first pair of legs 30 and the second pair of legs 32 angle slightly out with respect to the top surface 12 to achieve stability. Support of the top surface 12 is not limited to what is shown in the Figures. Other types of support may be used, but the support method must keep the changing table from moving during a diaper change and must support a wide range of infant weights.

An opening 38 is formed in the support structure 28. The opening 38 is formed at one end of the support structure 28 where the rear end of the baby will be positioned during the changing process. When the top surface 12 of the changing table 10 is coupled to the support structure 28, the opening 38 of the support structure 28 will be aligned with the opening 18 formed in the top surface 12.

The changing table 10 further contains a diaper dispensing container 40. The diaper dispensing container 40 has a hollow container 41. The container 41 may have a cover that is closed when the baby is being changed, but open when the next diaper is unfolded to the top surface. 42. The diaper dispensing container 40 is coupled to a bottom surface of the support structure 28 so that an opening 40A of the diaper dispensing container 40 is aligned with the opening 38 of the support structure 28 and the opening 18 formed in the top surface 12.

The diaper dispenser container 40 is located at one end of the top surface 12 where the rear end of the baby will be positioned during the changing process. The diaper dispensing container 40 holds a stack of diapers 44 for subsequent diaper changes. The top cover 42 fits over the opening of the diaper dispensing container 40. The top cover 42 protects the stored stack of diapers 44 in case of an unexpected accident by the baby when the baby is on the changing table 10 or over type of mess which may damage/soil the stored stack of diapers. In accordance with one embodiment of the present invention, the top cover 42 is a sliding type cover. This will allow a person changing the baby to more easily access the stack of new diapers stored in the diaper dispensing container 40.

The diaper dispensing container 40 has a spring mechanism 46. The spring mechanism 46 pushes the stack of diapers 44 upward as a diaper is removed. The spring mechanism 46 provides enough resistance to push the stack of diapers 44 upward as a diaper is removed and further to prevent a baby's foot from pushing downward and thus preventing the baby's foot from potentially getting caught in the diaper dispensing container 40. As shown in the Figures the spring mechanism 46 comprises a spring 46A. A platform 46B has a bottom surface coupled to the spring 46A. The spring 46A provides enough resistance to push platform 46B and the stack of diapers 44 upward as a diaper is removed and further to prevent a baby's foot from pushing downward and thus preventing the baby's foot from potentially getting caught in the diaper dispensing container 40. It should be noted that other types of devices may be used to pushes the stack of diapers 44 upward without departing from the spirit and scope of the present invention.

The rectangular hole 18 on the top surface 12 is sized so that it provides a lip over the diaper dispensing container 40. This lip retains the diapers as the spring mechanism 46 exerts an upward force.

The diaper dispensing container 40 may have an insert 49 which can be installed so that smaller diapers 47 are accommodated. Alternatively, the diaper dispensing container 40 may have sliding walls 48. The sliding walls 48 will allow one to adjust the size of the diaper dispensing container 40 to accommodate different size diapers. The sliding walls 48 will have a locking device 50 that will secure the sliding walls 48 into a desire position. Other devices may be used to adjust the size of the diaper dispensing container 40 without departing from the spirit and scope of the present invention. It should be noted that the above embodiments are only given as examples of different ways for the diaper dispensing container 40 to hold smaller diapers 47. Other means may be used without departing from the spirit and scope of the present invention.

The diaper dispensing container 40 may further contains an opening mechanism that unfolds a new diaper once a diaper is removed from the top surface 12. When a diaper is removed from the top surface 12, 40, the spring mechanism 46 pushes the stack of diapers 44 upward. The opening mechanism will unfold the new diaper so that the new diaper is conveniently located near the diaper fasteners 20, 22. The changing table 10 may further have one or more storage areas located on a bottom area of the top surface 12. The storage areas may be used to house wipes, diaper creams, cotton swabs, plastic bags for discarding used diapers, and the like. In accordance with one embodiment of the present invention, individual storage areas are provided to house different types of items. An alternative embodiment may include integrated holders, storage areas, and dispensers for the various diaper changing supplies.

The changing table 10 may further include a diaper cream dispenser. The diaper cream dispenser would have a dispensing mechanism which would dispense a set amount of diaper cream onto an applicator. When changing a diaper of a baby, the user can push a button which would dispense a set amount of diaper cream onto an applicator. The person changing the baby's diaper may then apply the diaper cream to the baby using the applicator.

Various other embodiments of the present invention are available. In one embodiment of the present invention, the top surface 12 is covered with padding. The padding will provide comfort of the infant. In accordance with another embodiment of the present invention, the changing table 10 will have a removable cover. The removable cover may also be padded. The removable cover may be washed if soiled.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. An infant changing table comprising:

a top surface;

an opening formed in a lower area of the top surface;

a support structure coupled to a back area of the top surface to elevate the top surface;

a diaper dispensing container coupled to the opening for holding a plurality of diapers, wherein the diaper dispensing container has a dispensing mechanism to dispense a next diaper when the top diaper is removed; and fasteners coupled to the top surface around the opening to hold down a top diaper being dispensed from the diaper dispensing container.

2. An infant changing table in accordance with claim 1 wherein the top surface has an antimicrobial coating.

3. An infant changing table in accordance with claim 1 wherein the support structure elevates the top surface at an angle so a head of a baby is elevated above feet of the baby.

4. An infant changing table in accordance with claim 1 wherein the diaper dispensing container comprises:

a hollow container having an open top area, the open top area coupled to the opening formed in a lower area of the top surface.

5. An infant changing table in accordance with claim 4 wherein the dispensing mechanism is a spring device which forces the next diaper to the opening when the top diaper is removed.

6. An infant changing table in accordance with claim 4 wherein the diaper dispensing container further comprises a lid member coupled to the open top area of the hollow container.

7. An infant changing table in accordance with claim 4 wherein the hollow container has an adjustment device to change a size of the hollow container.

8. An infant changing table in accordance with claim 4 wherein the hollow container has a pair of movable walls, the movable walls adjusting a size of the hollow container.

9. An infant changing table in accordance with claim 1 wherein the opening formed in a lower area of the top surface has curved side edges, the curved side edges protruding towards an interior of the opening.

10. An infant changing table comprising:

a top surface being concaved in shape;

an opening formed in a lower area of the top surface;

a support structure coupled to a back area of the top surface to elevate the top surface, the support structure elevates the top surface at an angle so a head of a baby is elevated above feet of the baby;

a diaper dispensing container coupled to the opening for holding a plurality of diapers;

a mechanism coupled to a bottom interior surface of the diaper dispensing container to dispense a next diaper when a top diaper is removed; and fasteners coupled to the top surface around the opening to hold down the top diaper being dispensed from the diaper dispensing container.

11. An infant changing table in accordance with claim 10 wherein the top surface has an antimicrobial coating.

12. An infant changing table in accordance with claim 10 wherein the diaper dispensing container comprises a hollow container having an open top area, the open top area coupled to the opening formed in a lower area of the top surface.

13. An infant changing table in accordance with claim 10 wherein the dispensing mechanism is a spring device coupled to the bottom interior surface of the diaper dispensing container, the spring device forces the next diaper to the opening when the top diaper is removed.

14. An infant changing table in accordance with claim 12 wherein the diaper dispensing container further comprises a lid member coupled to the open top area of the hollow container.

15. An infant changing table in accordance with claim 12 wherein the hollow container has adjustment device to change a size of the hollow container.

16. An infant changing table in accordance with claim 12 wherein the hollow container has a pair of movable walls, the movable walls adjusting a size of the hollow container.

17. An infant changing table in accordance with claim 10 wherein the opening formed in a lower area of the top surface has curved side edges, the curved side edges protruding towards an interior of the opening.

18. An infant changing table comprising:

a top surface being concaved in shape;

an opening formed in a lower area of the top surface;

a support structure coupled to a back area of the top surface to elevate the top surface, the support structure elevates the top surface at an angle so a head of a baby is elevated above feet of the baby;

a diaper dispensing container coupled to the opening for holding a plurality of diapers, the diaper dispensing container comprising:

a hollow container having an open top area, the open top area coupled to the opening formed in a lower area of the top surface; and an adjustment device coupled to the hollow container to change a size of the hollow container;

a mechanism coupled to a bottom interior surface of the diaper dispensing container to dispense a next diaper when a top diaper is removed; and fasteners coupled to the top surface around the opening to held down the top diaper being dispensed from the diaper dispensing container.

19. An infant changing table in accordance with claim 18 wherein the diaper dispensing container further comprises a lid member coupled to the open top area of the hollow container.

20. An infant changing table in accordance with claim 18 wherein the opening formed in a lower area of the top surface has curved side edges, the curved side edges protruding towards an interior of the opening.

* * * * *